United States Patent [19]

Dobbs

[11] Patent Number: 4,747,523

[45] Date of Patent: May 31, 1988

[54] MANUALLY ACTUATED DISPENSING PUMP

[75] Inventor: Douglas B. Dobbs, Yorba Linda, Calif.

[73] Assignee: Calmar, Inc., Watchung, N.J.

[21] Appl. No.: 63,920

[22] Filed: Jun. 19, 1987

[51] Int. Cl.[4] ..... B67D 5/40

[52] U.S. Cl. ..... 222/383; 222/341; 239/333; 239/526; 417/435

[58] Field of Search ..... 239/331, 333, 526; 417/435, 489–490, 498; 222/318, 321, 340–341, 372, 380, 383, 385

[56] References Cited

U.S. PATENT DOCUMENTS

| | | | |
|---|---|---|---|
| 3,463,093 | 8/1969 | Pfeiffer et al. | 417/547 |
| 3,774,849 | 11/1973 | Boris | 239/338 |
| 4,191,313 | 3/1980 | Blake et al. | 222/335 |
| 4,225,060 | 9/1980 | Kutik | 222/189 |
| 4,317,531 | 3/1982 | Saito et al. | 222/321 |
| 4,365,751 | 12/1982 | Saito et al. | 239/333 |
| 4,402,432 | 9/1983 | Corsette | 222/321 |
| 4,489,861 | 12/1984 | Saito et al. | 222/207 |
| 4,489,890 | 12/1984 | Martin | 239/333 |
| 4,618,077 | 10/1986 | Corsette | 222/383 |
| 4,624,413 | 11/1986 | Corsette | 239/333 |
| 4,669,664 | 6/1987 | Garneau | 239/333 |
| 4,674,659 | 6/1987 | Micallef | 417/498 X |

*Primary Examiner*—Michael S. Huppert

*Attorney, Agent, or Firm*—Watson, Cole, Grindle & Watson

[57] ABSTRACT

A manually actuated dispensing pump having a pump body extending transversely above a closure cap adapted for mounting the body at the upper end of a container, has an outwardly open pump cylinder for the reception of a reciprocable piston having spaced piston seals. To facilitate pump priming, the inboard seal is positioned relative to the inlet port so that the inboard seal overlies the inlet port at a predetermined position during the inward pressure stroke of the piston to permit flow of entrapped air from the pump chamber outwardly of the pump cylinder via the annular chamber defined between the piston seals.

2 Claims, 1 Drawing Sheet

MANUALLY ACTUATED DISPENSING PUMP

BACKGROUND OF THE INVENTION

This invention relates generally to improvements in dispensing pumps of the type set forth in U.S. Pat. No. 4,618,077.

Such manually actuated dispensing pump has a pump body capable of being mounted via a closure cap at the upper end of a container of liquid product to be dispensed, the pump body extending generally transversely above the closure cap. The pump body includes outwardly opening cylinder means providing at its inner end region a pump chamber for a manually reciprocable piston. The pump has a valve controlled inlet passage terminating in an inlet port opening into the pump chamber, and a valve controlled discharge passage leading from the pump chamber. The pump cylinder means has a vent port positioned outboard of the pump chamber and in open communication with the interior of the container. The piston has a pair of spaced, annular piston seals defining an annular chamber therebetween. The inboard seal operates in the pump chamber, and the outboard seal is positioned outwardly of the vent port in all operative positions of the pump piston. In a non-pumping position, the outboard seal seals off the vent port from the atmosphere. And, means such as vent rib is located at the wall of the cylinder means outboard of the vent port for interrupting the sealing function of the outboard seal during pumping to thereby open the vent.

However, it is difficult to prime such a pump since the air initially occupying the pump chamber is merely elastically compressed on the inward pressure stroke, without obtaining a sufficiently high pressure to move the discharge valve to an open position. On each suction stroke of the piston, the entrapped air merely expands, with the result that little or no liquid is drawn into the pump chamber. Thus a large number of pump strokes is required to prime the pump.

SUMMARY OF THE INVENTION

It is therefore an object of the present invention to avoid the aforementioned pump priming difficulty by the provision of a manually actuated dispensing pump of the type characterized above as having a priming feature which renders the pump highly effective, simple to operate and economical to produce.

The manually actuated dispensing pump which incorporates the pump priming feature of the invention includes a pump body capable of being mounted with a closure cap at the upper end of a container of liquid product to be dispensed, the pump body extending generally transversely above the closure cap, and the body having a pump cylinder open at its outer end to atmosphere and having at its inner end region a pump chamber for a manually reciprocable piston. The pump body has a positively controlled or a passive venting means. The pump cylinder has an inlet port opening into the pump chamber, the port being in open communication with a valve controlled inlet passage. Moreover, the cylinder has in its lower region an outboard port located outwardly of the pump chamber and in open communication with the interior of the container. The piston has an annular inboard seal in sealing engagement with the wall of the pump chamber, and has an annular outboard seal spaced outwardly of the outboard port in all operative positions of the pump piston and sealingly engages at least a lower region of the inner surface of the cylinder in such operative positions. The inboard and outboard seals are spaced apart to define an annular chamber in communication with the outboard port. The relative positioning between the inboard seal and the inlet port is such that the inboard seal overlies the inlet port at a predetermined position during the inward pressure stroke of the piston to thereby permit flow of entrapped air from the pump chamber outwardly of the pump cylinder via the annular chamber.

And, the wall of the pump chamber may be countersunk around the inlet port to enhance the flow of entrapped air from the pump chamber.

DETAILED DESCRIPTION OF THE INVENTION

Figure 1:
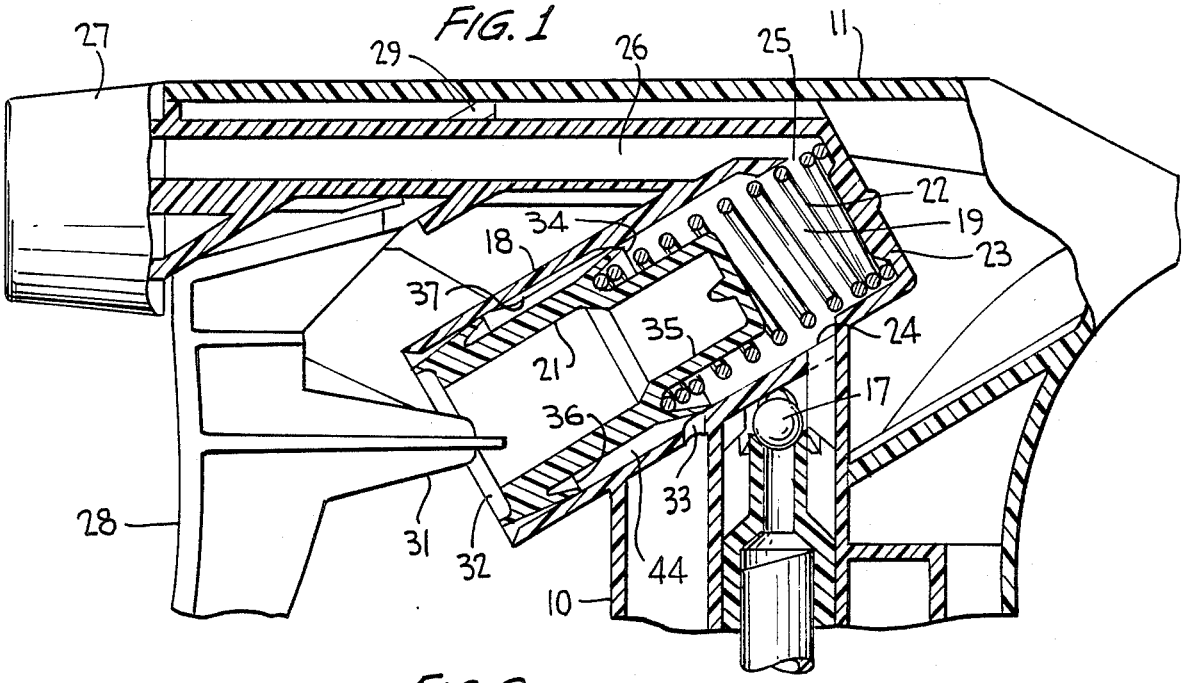
FIG. 1 is a side elevational view of the manually actuated dispensing pump incorporating the pump priming feature of the invention, partly broken away and sectioned, the pump piston being shown in its outwardly extended inoperative position.
Figure 2:
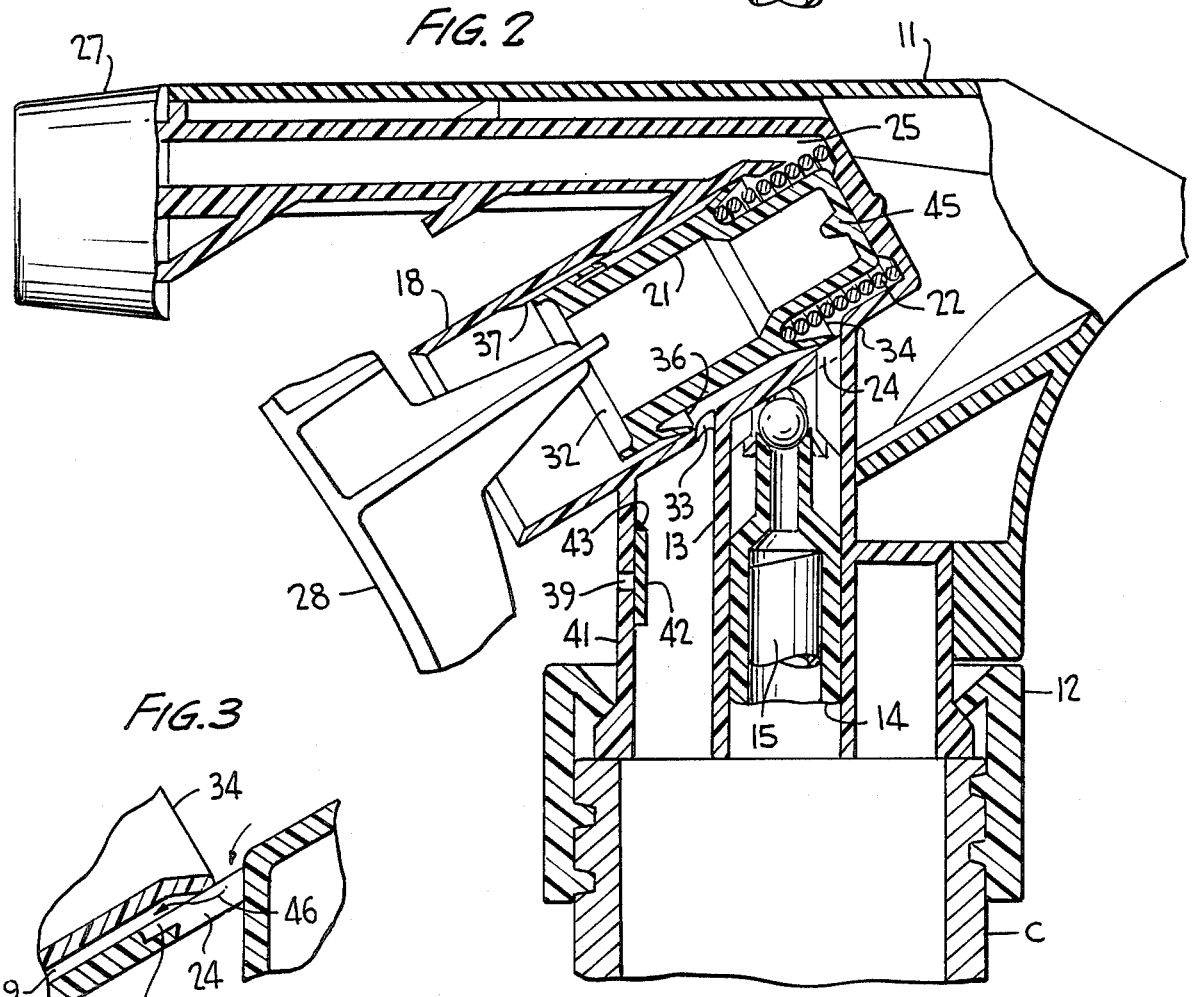
FIG. 2 is a view similar to FIG. 1 but with the piston manually actuated inwardly to effect pump priming.

Turning now to the drawings wherein like reference characters refer to like and corresponding parts throughout the several views, the pump structure illustrated in FIGS. 1 and 2 is of the general type disclosed in U.S. Pat. No. 4,418,077. Such a pump comprises a pump housing or body 10 which may have an outer shroud cover 11, the body being adapted for mounting with a closure cap 12 at the neck of a container C, not otherwise shown. An inner cylinder 13 of the pump body supports a tube retainer 14 which suspends a conventional dip tube 15 extending into the interior of the container. The dip tube and upper end of the tube retainer define an inlet passage 16 which is valve controlled by a conventional ball check valve 17 supported on a valve seat at the upper end of the tube retainer.

A pump cylinder 18 located above the closure cap opens at its outer end to the atmosphere and has at its inner end region a pump chamber 19 for a manually reciprocable pump piston 21. A coil return spring 22 extends between end wall 23 of the pump chamber and some suitable portion of the piston for extending the piston outwardly of the cylinder to its inoperative position of FIG. 1.

The inlet passage terminates in an inlet port 24 which opens into the pump chamber. A discharge port 25 opening from the pump chamber communicates with discharge passage 26 which is valve controlled by suitable valving (not shown) located within a rotatable nozzle cap 27.

A trigger actuator 28 is hinged to the pump body in some suitable manner as at 29, the trigger having an actuator flange or flanges 31 for bearing against an outer circular rim 32 of the piston.

The pump cylinder also has a sump port 33 (which may also function as a vent port, as will be explained) located outboard of the pump chamber and in open communication with the interior of the container.

The pump piston has an inboard annular piston seal 34 in sealing engagement with the wall of the pump chamber. This piston seal extends in a direction toward the pump chamber and is spaced from cylindrical wall 35 of the nose of the piston to form a convenient shoulder for the reception of return spring 22. And, the piston has an outboard annular piston seal 36 spaced outwardly of port 33 in all operative positions of the pump piston as shown in FIGS. 1 and 2. Seal 36 sealingly engages the wall cylinder 18 in the inoperative position of the piston shown in FIG. 1. Seal 36 is inwardly directed as shown, and may be of flexible material.

An axial vent rib 37, or an equivalent vent groove, may be provided at the inner surface of cylinder 18 for interrupting seal 36 during pumping to establish vent passages as seal 36 is distorted during contact upon each inward stroke of the pistion. Seal 36 may therefore function as vent valve, as described in U.S. Pat. No. 4,618,077, which automatically opens simultaneously with inward displacement thereof by rib 37, with the result that each time a charge of flowable product is delivered through the discharge port to atmosphere, a vent passage is in open communication with the atmosphere through the clearance of space between seal 36 and the inner wall of cylinder 18 as produced by rib 37. Thus, atmospheric air may be drawn into the container through port 33 as necessary to replenish dispensed product.

Otherwise, rib 37, or its equivalent groove, may be eliminated such that the sealing engagment between seal 36 and the wall of cylinder 18 is not interrupted during pumping upon each pressure stroke of the piston. Instead, a vent port 39 may be located in neck portion 41 of the pump body, the port being normally closed by a flexible vent flap 42 hinged as at 43 to the inside of the neck portion. Thus, as product is suctioned into the pump chamber during each suction stroke of the piston, the negative pressure established by the increased air volume within the container causes flap 42 to move inwardly away from port 39 in response to external atmospheric pressure, to thereby prevent hydraulic lock within the container as atmospheric air replenishes dispensed product.

Seals 34, 36 are spaced apart to define an annular chamber 44 in communication with port 33. Thus, any blow-by of product from around piston seal 34 during the pumping operation will simply collect within chamber 44 and will be purged from that chamber back into the container through port 33 by the inwardly moving seal 36.

Pump priming according to the invention is established by relatively positioning seal 34 and inlet port 24 such that seal 34 overlies the inlet port at a predetermined position during the inward pressure stroke of the piston. Such a predetermined position is shown in FIG. 2 as the end of the pressure stroke in which end wall 45 of the piston nose bottoms out against inner wall 23 of the piston cylinder. Such predetermined position may be otherwise established without departing from the invention.

Figure 3:
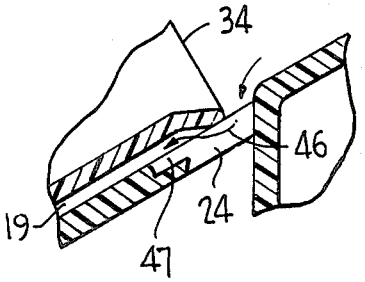
FIG. 3 is a slightly enlarged detail view illustrating the flow of entrapped air from the pump chamber at the FIG. 2 pump position.

In this relative position in which piston seal 34 overlies intake port 24, entrapped air is permitted to flow from the pump chamber, in the direction of arrow 46 of FIG. 3, outwardly of the pump cylinder via annular chamber 44. This flow outwardly of the pump cylinder may be through the open end of the cylinder and/or through port 33. In either event, unwanted air is effectively purged from the pump chamber.

As shown in FIG. 3, the wall of the pump chamber may be countersunk as at 47 around inlet port 24 to enhance the flow of entrapped air from the pump chamber.

The mode of operation of the aforedescribed pump is believed understood from the drawings. Thus, the pump chamber before priming may contain substantially large volumes of air which must be evacuated and replaced by liquid. Unless the air is purged from the pump chamber, a comparatively large volume of air occupying the pump chamber as the piston is inwardly stroked a few times, fails due to its high compressibility to transmit sufficient thrust to the discharge valve (not shown) located at the end of the discharge passage. Thus, the discharge valve remains seated and an air lock forms in the pump chamber.

In accordance with the invention, a few inward strokes of the piston, upon actuation of the trigger, moves the piston seal 34 each time to overlie the inlet port, as shown in FIG. 2, such that unwanted air is purged from the pump chamber around seal 34 as permitted by the inlet opening (FIG. 3), into annular chamber 44 and into the container through port 33 or otherwise through the open end of the pump cylinder as facilitated by vent rib 37. Once the pump is primed with product, each inward stroke of the piston compresses the liquid in the pump chamber and forces it out through the discharge passage and through the discharge orifice provided in a normal manner. During each suction stroke of the piston upon release of the trigger actuator, the reduced pressure within the pump chamber occasioned by the expanded pump chamber volume suctions product from the container up through the dip tube unseating ball valve 17 and filling the pump chamber through inlet port 24. During the pumping operation, vent seal 34 normally does not reach the inlet port due to the incompressability of the liquid within the chamber. And, during pumping, any leakage of product from around seal 36 enters chamber 44 and is conveniently purged from this chamber back into the container through port 33 by the piston like operation of seal 36.

Obviously, many other modifications and variations of the present invention are made possible in the light of the above teachings. It is therefore to be understood that within the scope of the apended claims the invention may be practiced otherwise than as specifically described.

What is claimed is:

1. A manually actuated dispensing pump comprising, a pump body for mounting with a closure cap at the upper end of a container for fluent product, said pump body extending transversely above the closure cap, said body having a pump cylinder open at its outer end to atmosphere and having at its inner end region a pump chamber for a manually reciprocable piston, said pump body having venting means, said cylinder having an inlet port opening into said chamber and in communication with a valve controlled inlet passage, and said cylinder having in its lower region an outboard port positioned ouwardly of said chamber and in open communication with the interior of the container, said piston having a first annular piston seal in sealing engagement with the wall of said pump chamber, and said piston having a second annular piston seal spaced outwardly of said outboard port in all operative positions of said pump piston and sealingly engaging at least a lower region of the inner surface of said cylinder in said operative positions, said piston seals being spaced apart to define an annular chamber in communication with said outboard port, said first piston seal and said inlet port being relatively positioned such that said first piston seal overlies said inlet port at a predetermined position during the inward pressure stroke of said piston to permit flow of entrapped air from said pump chamber outwardly of said pump cylinder via said annular chamber.

2. The pump according to claim 1, wherein the wall of said pump chamber is countersunk around said inlet port to enhance the flow of entrapped air from said pump chamber.

* * * * *